US009664050B2

(12) United States Patent
Hippen et al.

(10) Patent No.: US 9,664,050 B2
(45) Date of Patent: May 30, 2017

(54) BEARINGS FOR A TURBOMACHINE HAVING AN ELECTRIC MOTOR

(71) Applicant: EcoMotors, Inc., Allen Park, MI (US)

(72) Inventors: Will Robert Nielsen Hippen, Eureka, CA (US); Christopher Meszaros, Brighton, MI (US); Tyler Garrard, Buellton, CA (US)

(73) Assignee: EcoMotors, Inc., Allen Park, MI (US)

( * ) Notice: Subject to any disclaimer, the term of this patent is extended or adjusted under 35 U.S.C. 154(b) by 350 days.

(21) Appl. No.: 14/483,554

(22) Filed: Sep. 11, 2014

(65) Prior Publication Data

US 2015/0118044 A1 Apr. 30, 2015

Related U.S. Application Data

(63) Continuation-in-part of application No. PCT/US2014/017455, filed on Feb. 20, 2014.
(Continued)

(51) Int. Cl.
*F01D 5/02* (2006.01)
*F01D 5/04* (2006.01)
(Continued)

(52) U.S. Cl.
CPC ..... *F01D 5/025* (2013.01); *F01D 5/048* (2013.01); *F01D 15/10* (2013.01); *F01D 25/166* (2013.01);
(Continued)

(58) Field of Classification Search
CPC . F01D 5/025; F01D 5/04; F01D 5/043; F01D 5/048; F01D 15/10; F01D 25/16;
(Continued)

(56) References Cited

U.S. PATENT DOCUMENTS 2,242,360 A 5/1941 Lessmann
3,174,152 A 3/1965 Maclay
(Continued)

FOREIGN PATENT DOCUMENTS

JP 402221635 A 9/1990
JP 2006238661 A 9/2006
(Continued)

OTHER PUBLICATIONS

PCT Search Report for PCT/US2015/045908, completed Nov. 19, 2015.

*Primary Examiner* — Gregory Anderson
*Assistant Examiner* — Christopher R Legendre
(74) *Attorney, Agent, or Firm* — Barnes & Thornburg LLP

(57) ABSTRACT

An electronically-controlled turbocharger (ECT) includes a rotor (of an electric motor) on the shaft of the turbomachine. There are a variety of embodiments for securing the rotor onto the shaft including, but not limited to: having a taper on both the shaft on the rotor and using a nut engaging with threads in the shaft to put the two tapers together; a press fit; splines and grooves also using a nut; and a shoulder on the shaft that the rotor abuts when a nut is engaged with threads on the shaft. To accommodate these retaining features, the diameter of the shaft is greater near the turbine end of the shaft. A first bearing installed on the shaft near the turbine end of the shaft has a larger inside diameter than a second bearing installed on the other side of the rotor.

10 Claims, 3 Drawing Sheets

Related U.S. Application Data

(60) Provisional application No. 61/895,632, filed on Oct. 25, 2013.

(51) Int. Cl.
*F01D 15/10* (2006.01)
*F01D 25/16* (2006.01)
*F04D 29/05* (2006.01)

(52) U.S. Cl.
CPC ..... *F04D 29/05* (2013.01); *F05D 2220/40* (2013.01); *F05D 2220/76* (2013.01); *F05D 2230/10* (2013.01); *F05D 2230/20* (2013.01); *F05D 2230/31* (2013.01); *F05D 2230/60* (2013.01); *F05D 2230/90* (2013.01); *F05D 2240/60* (2013.01); *F05D 2250/281* (2013.01); *F05D 2250/292* (2013.01); *F05D 2260/30* (2013.01)

(58) Field of Classification Search
CPC .... F01D 25/162; F01D 25/164; F01D 25/166; F01D 25/168; F04D 29/05; F04D 29/053; F04D 29/056; F05D 2240/60
See application file for complete search history.

(56) References Cited

U.S. PATENT DOCUMENTS 3,812,392 A 5/1974 Barton
3,890,780 A * 6/1975 Hagemeister ..... F01D 25/16 184/6.11
4,060,337 A * 11/1977 Bell, III ..... F04D 29/284 416/186 R
4,268,229 A * 5/1981 Berg ..... F01D 11/00 415/111
4,655,616 A 4/1987 Ducan
5,382,858 A 1/1995 Sugiyama
6,327,857 B1 * 12/2001 Fredriksson ..... F01D 25/166 60/605.1
7,946,118 B2 * 5/2011 Hippen ..... F01M 11/02 184/6.16
8,174,141 B2 * 5/2012 Delf ..... F02B 41/10 290/52
8,602,655 B2 * 12/2013 Tabata ..... F01D 5/027 384/490
9,044,833 B2 * 6/2015 Holzschuh ..... B23P 15/006
9,401,630 B2 * 7/2016 Garrard ..... H02K 9/19
2006/0013693 A1 1/2006 Meacham
2007/0292268 A1 12/2007 Nishiyama
2008/0000323 A1 1/2008 Zacche' et al.
2009/0010760 A1 1/2009 Hayasaka
2009/0025386 A1 1/2009 Rumsby
2010/0212643 A1 8/2010 Goedecke
2010/0218498 A1 9/2010 Shibui
2010/0252341 A1 * 10/2010 Shu ..... H02K 16/02 180/65.21
2010/0308685 A1 12/2010 Hippen
2011/0074242 A1 3/2011 Singhal
2014/0125208 A1 * 5/2014 Yamashita ..... F02C 6/12 310/68 B
2014/0147306 A1 * 5/2014 Yamashita ..... F02B 37/10 417/410.1
2015/0118044 A1 * 4/2015 Hippen ..... F01D 25/166 415/229
2016/0003140 A1 * 1/2016 Garrard ..... F02B 39/00 417/423.1

FOREIGN PATENT DOCUMENTS

JP DE 102006000452 A1 * 3/2007 ..... F02B 37/11
JP WO 2012169463 A1 * 12/2012 ..... F02B 37/10
WO 2014130707 A1 8/2014

* cited by examiner

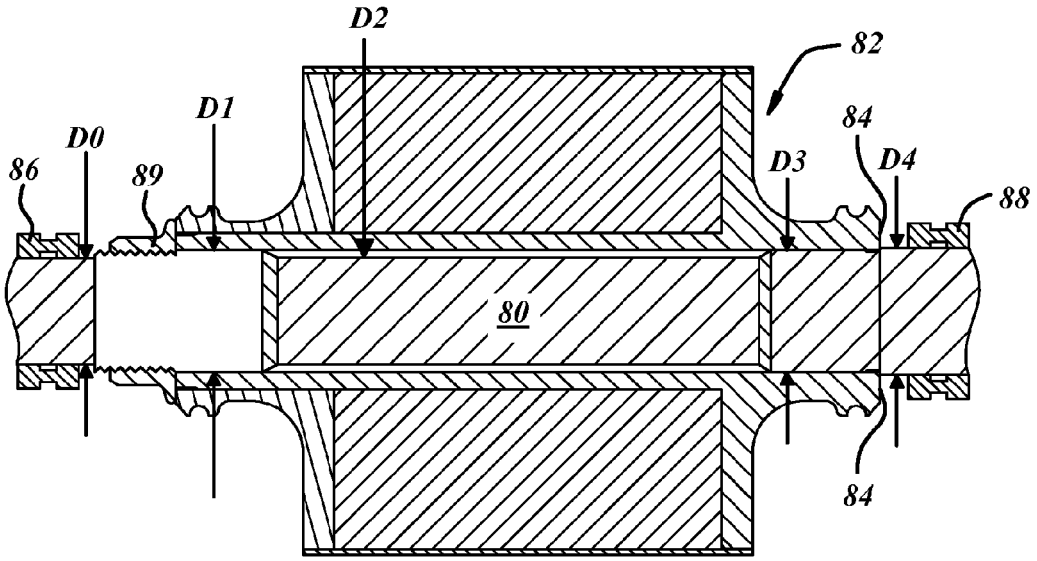
FIG. 3 D4 > D3 ≥ D1 > D0
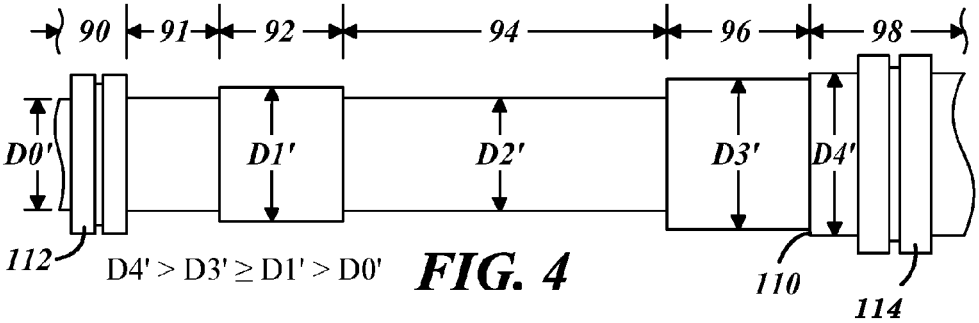
D4' > D3' ≥ D1' > D0' FIG. 4
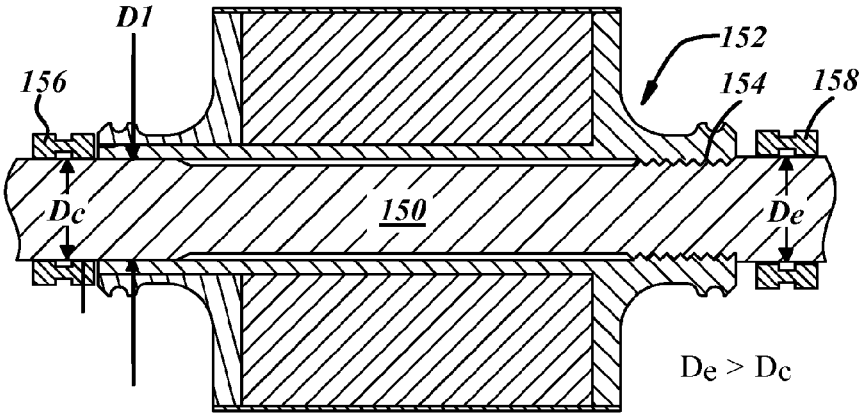
De > Dc
FIG. 6

BEARINGS FOR A TURBOMACHINE HAVING AN ELECTRIC MOTOR

FIELD

The present disclosure relates to bearings of a shaft of an electric motor.

BACKGROUND

An electronically-controlled turbomachine (ECT) includes an electric machine (or motor) mounted between turbine and compressor sections of a turbomachine. The turbomachine rotates at speeds up to 350,000 rpm.

The rotor of the electric machine should be mounted to resist relative rotation between the rotor and the turbocharger shaft. The rotor may be press fit onto the shaft as described in commonly-assigned patent application PCT/US 14/17455 filed 20 Feb. 2013, which is incorporated herein in its entirety. Other rotor retention embodiments are disclosed in commonly-assigned provisional patent application 61/895,632 filed 25 Oct. 2013.

The rotordynamics, which include the bearings, of such a system are critical to provide the desired performance and durability.

SUMMARY

To provide desirable rotordynamics, an ECT is disclosed that has: a shaft having a turbine end and a compressor end with a turbine wheel coupled onto the turbine end of the shaft, a rotor mounted onto the shaft, a first bearing having a first internal diameter, the first bearing being mounted on the shaft between the turbine wheel and the rotor, and a second bearing having a second internal diameter, the second bearing being mounted on the shaft between the rotor and the compressor end of the shaft wherein the first diameter is greater than the second diameter.

In one embodiment the shaft has an exterior taper on the shaft with a diameter of the taper decreasing monotonically in a direction moving away from the turbine wheel. An end of the rotor core that engages with the taper has an interior taper section which mates with the exterior taper. The interior diameter of the interior taper decreases monotonically in a direction moving away from the turbine wheel.

In some embodiments at least one of the interior and exterior tapers is roughened by one of: knurling, bead blasting, etching, sand blasting, laser vapor deposition, laser etching, and applying a coating.

In another embodiment the shaft has a shoulder located between the rotor and the turbine wheel and an end of the rotor abuts the shoulder.

In another embodiment, the shaft has a taper located proximate an end of the rotor proximate the turbine wheel. In an alternative embodiment the shaft has a shoulder located proximate an end of the rotor proximate the turbine wheel. The shaft has threads along a portion of the length of the shaft proximate an end of the rotor away from the turbine wheel. The ECT also includes a nut that engages with the threads and abuts the rotor on the end of the rotor away from the turbine wheel.

In yet another embodiment, the rotor is press fit onto the shaft between the first and second bearings at least for a portion of the rotor. In some embodiments, the shaft is cutback in the center of the portion that the rotor is over the shaft so that the inside of the rotor and the shaft do not contact each other in the area of the cutback.

In another embodiment, an end of the rotor has grooves defined therein; the shaft has splines defined therein; the splines mate with the grooves upon assembly of the rotor onto the shaft to thereby prevent relative radial motion of the rotor with respect to the shaft; and the shaft is threaded upon a portion of its length at a location near the compressor end of the shaft. The ECT may also have a nut that engages with the threads of the shaft and abuts the rotor near the compressor end of the shaft.

In an alternative embodiment: the rotor has internal threads; the shaft has external threads; and the rotor is mounted on the shaft by engaging the threads of the rotor with the threads of the shaft.

The first and second bearings are fully floating bearings and include an oil groove in some embodiments.

The ECT further includes a housing that is installed over the rotor. The first bearing is mounted on the shaft between the turbine wheel and the rotor taken in a direction parallel to an axis of the shaft and mounted between the shaft and the rotor housing taken in a radial direction perpendicular to the axis of the shaft. The second bearing is mounted on the shaft between the compressor wheel end of the shaft and the rotor taken in a direction parallel to the axis of the shaft and mounted between the shaft and the rotor housing taken in a radial direction perpendicular to the axis of the shaft.

Also disclosed is a method to assemble an ECT including: sliding a first bearing of a first diameter over a shaft of the ECT, installing a rotor onto the shaft, engaging threads of a nut onto threads formed in the shaft (in embodiments with a nut) and sliding a second bearing of a second diameter over a shaft of the ECT. The first diameter is greater than the second diameter. In embodiments in which the rotor has threads, the installing is accomplished by spinning the rotor onto the shaft. In embodiments with a nut that engages with threads on the shaft, the nut is installed to secure the rotor on the shaft prior to installing the second bearing. In most embodiments in which a press fit is used involves heating the rotor, cooling the shaft, or both to allow the rotor to slide over the shaft, which could not be accomplished at room temperature due to an interference fit.

BRIEF DESCRIPTION OF THE DRAWINGS

FIG. 3 is a cross section of a portion of an ECT: shaft, rotor, and two bearings;

FIG. 4 is a portion of an ECT shaft with bearings;

FIG. 6 shows an ECT shaft that engages with the rotor via threads; and

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
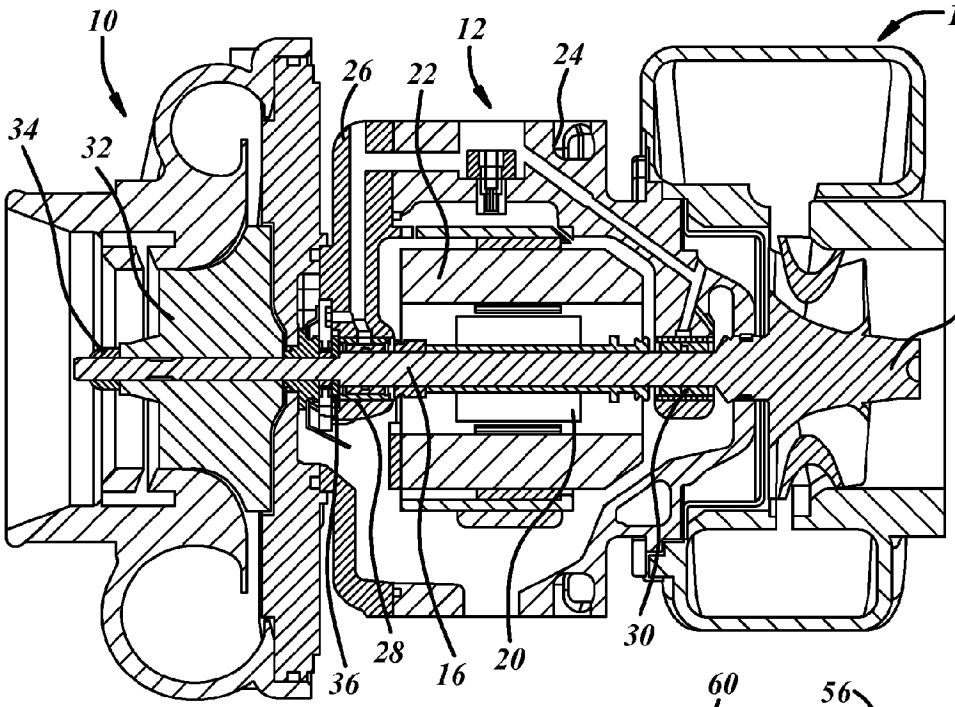
FIG. 1 is a cross-sectional view of an ECT.

ECT herein is used to denote both electronically-controlled turbocharger and electronically-controlled turbomachine, with the electronically-controlled turbocharger being one type of electronically-controlled turbomachine. In FIG. 1, an ECT is shown in cross section. The ECT has a compressor section 10, an electric machine section 12, and a turbine section 14. A shaft 16 passes through sections 10, 12, and 14. A turbine wheel 18 is affixed to shaft 16 by welding, by mechanical fasteners, or any other suitable manner of coupling rotating members.

Electric machine section 12 includes an electric machine that includes a rotor 20 and a stator 22 enclosed within two housing portions: a turbine-side housing portion 24 and a compressor side housing portion 26. The electric machine can be operated as either a motor, in which electrical energy is applied to the motor to cause the shaft to rotate faster than it would otherwise, or as a generator, in which an electrical load is applied to the motor to cause the shaft to rotate slower than it would otherwise. The terms electric machine, motor, and generator are used herein interchangeably with the understanding that depending on the embodiment, the electric machine may be operated as a motor, generator, or neither if no electric current is applied to windings associated with the rotor. In some embodiments, the electric machine may be adapted to operate only as a motor or only as a generator. Bearings 28 and 30 are disposed in housing portions 26 and 24, respectively, to support shaft 16. Considered axially, bearing 30 is located between rotor 20 and turbine section 14 and journal bearing 28 is located between rotor 20 and compressor section 10.

A compressor wheel 32 is provided on the end of shaft 16 distal from turbine wheel 18 with a thrust washer 36 located between compressor wheel and bearing 28. Compressor wheel 32 is held onto shaft 16 via a nut 34 in the embodiment of FIG. 1. The compressor wheel 32 is typically manufactured from a light alloy dissimilar from the turbo shaft 16 preventing a weldment. Compressor wheel 32 is typically secured onto the shaft via a fastener or threaded feature. Any suitable coupler may be used.

Figure 2:
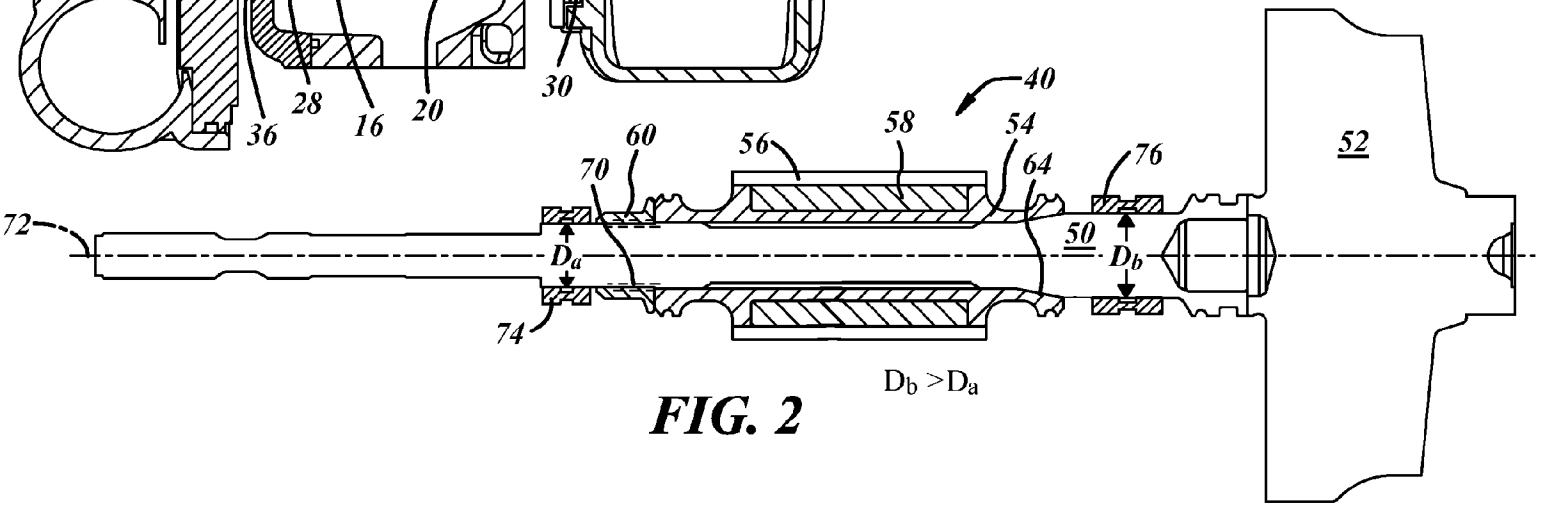
FIG. 2 is a cross-sectional view of an ECT shaft, turbine wheel; and bearings.

In FIG. 2, a shaft 50 is welded to a turbine wheel 52. A rotor core 54 of a rotor 40 is placed over shaft 50. Permanent magnets 58 surround rotor core 54 with an outer containment sleeve 56 containing permanent magnets 58. In the present embodiment, the rotor core is a stiffener sleeve. In other embodiments, the permanent magnets sit directly on the shaft. Rotor core 54 is shown in FIG. 2 as a single piece. However, the rotor core may be made up of a plurality of sections, such as a center section and two end caps. Shaft 50 has threads 70. Nut 60 engages with threads 70. An inner surface of an end of rotor core 54 proximate turbine 52 is tapered to mate with a taper 64 on shaft 50. A bearing 74 is mounted on shaft 50 at a location where the diameter is Da and a bearing 76 is mounted on shaft 50 at a location where the diameter is Db. Due to Db being to the right of taper 64, Db is greater than Da, which means that the inner diameter of bearing 76 is greater than the inner diameter of bearing 74.

The embodiment in FIG. 2 shows a rotor of a permanent magnet electric motor. However, this is not intended to be limiting. A rotor of any suitable electric motor may be mounted on shaft 50.

In various embodiments, some mating surfaces may be roughened to increase friction to resist disassembly. The mating surfaces may be roughened by laser surface treatments, sand blasting, knurling, ball peening or any other suitable technique. In one embodiment, at least one of the end of the rotor core 54 proximate turbine 52 and taper 64 has a roughened surface.

In FIG. 3, a portion of a shaft 80 and a rotor 82 for an ECT is shown. The shaft has a diameter D0 at the left hand side, which in some embodiments can be the compressor end of shaft 80. To the right of the D0 section is a section of greater diameter, D1, that forms a press fit with the inner surface of rotor 82. To the right of the D1 section is a cutback portion of the shaft with diameter, D2. The cutback can make it easier to press the rotor onto the shaft by reducing the length of the press fit. Furthermore, in some cases, the shaft rotordynamics are improved with a cutback. To the right of the D2 section is a portion of the shaft with diameter, D3. D3 can be equal to D2 or greater. To locate rotor 82 onto shaft 80 during assembly, a small shoulder is provided on shaft 80 between the D3 section and a section of slightly greater diameter, D4. A nut 89 engages with threads in shaft 80 to secure rotor 82 to shaft 80. End 84 of rotor 82 abuts the shoulder of shaft 80 when nut 89 is tightened. The shoulder exists due to D4 being of a greater diameter than D3. All of the transitions between varying diameters may be chamfered or use any suitable stress relief feature. Bearing 86 that is placed over the D0 section has a smaller inside diameter than bearing 88 that is placed over the D4 section of shaft 80. D4 is greater than D3 which is greater than or equal to D1 that is greater than D0. D2 is less than any of D1, D3, and D4. D2 may be the same as, greater than, or less than D0.

A portion of a shaft is shown in FIG. 4. The shaft has a section 90 with outside diameter D0' that has a bearing 112 mounting onto it. Section 92 has a diameter D1' that press fits with an inside portion of a rotor (not shown). Section 94 is cutback and has a diameter D2' which is less than either D1' or D3', the outside diameter of section 96. Section 98 of the shaft has an outside diameter D4'. The shaft has a shoulder 110 that abuts a rotor that may be press fit or secured in any suitable manner onto the shaft. A section 91 may be provided with threads for a nut to secure the rotor. A bearing 114 is mounted on section 98. The inside diameter of bearing 114 is greater than the inside diameter of bearing 112. Bearings 112 and 114 have a central oil groove. However in other embodiments, other suitable bearing types are employed.

Figure 5:
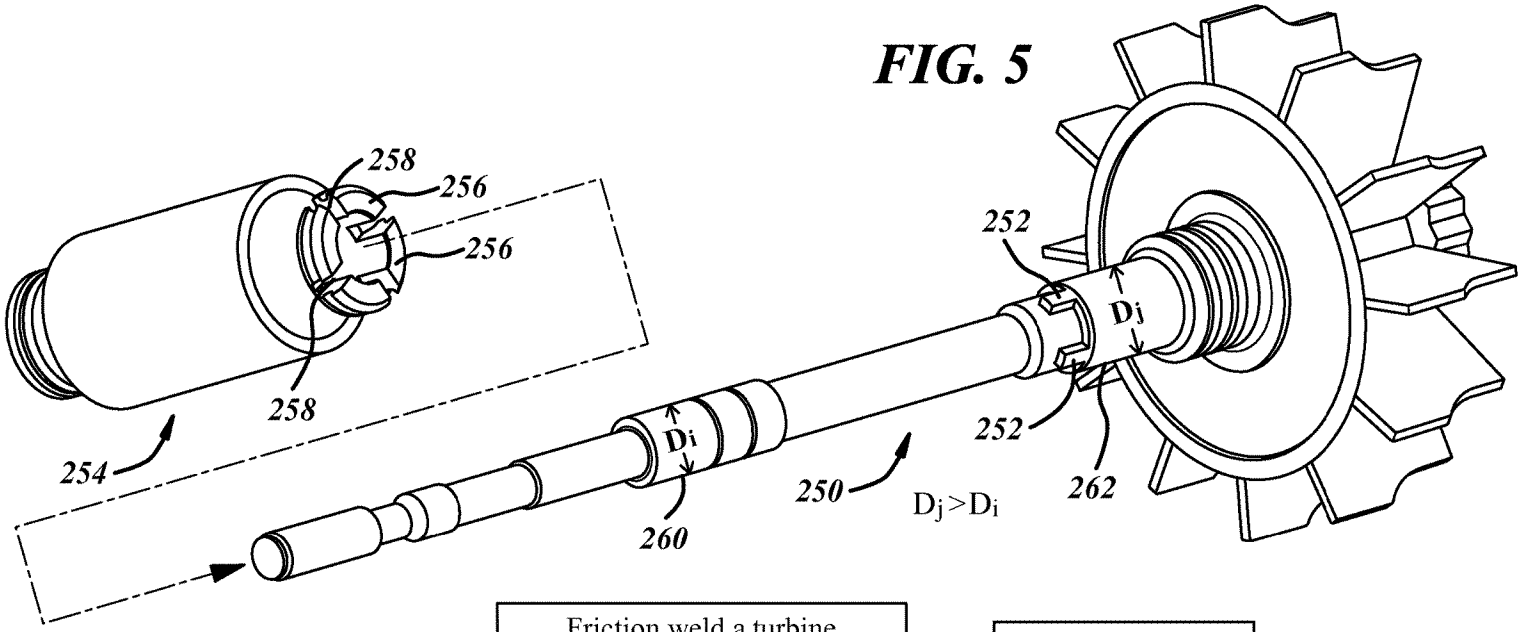
FIG. 5 is an ECT shaft that engages with rotor via splines and grooves.

In an embodiment shown in FIG. 5, a shaft 250 is provided with a plurality of splines 252 and a rotor 254 is provided with a plurality of fingers 256 and grooves 258. Splines 252 mate with grooves 258. A first bearing (not shown) is placed over a section 262 of shaft 250 that has a diameter, Dj, and a second bearing (not shown) is placed over a section 260 of shaft 250 that has a diameter, Di. Diameter Dj is greater than diameter Di, which means that the inside diameter of the first bearing is greater than the diameter of the second bearing.

FIG. 6 shows yet another embodiment in which a shaft 150 has outer threads provided in the region 154 of engagement between shaft 150 and a rotor 152. Rotor 152 has inner threads that mate with the threads of shaft 150. Because of the threads in region 154, the diameter of shaft 154 at De is greater than the diameter of shaft 152 at Dc. Thus, the inside diameter of a bearing 156 on shaft 150 is smaller than the inside diameter of a bearing 158 on shaft 150 on that is on the opposite end of rotor 152.

Figure 7:
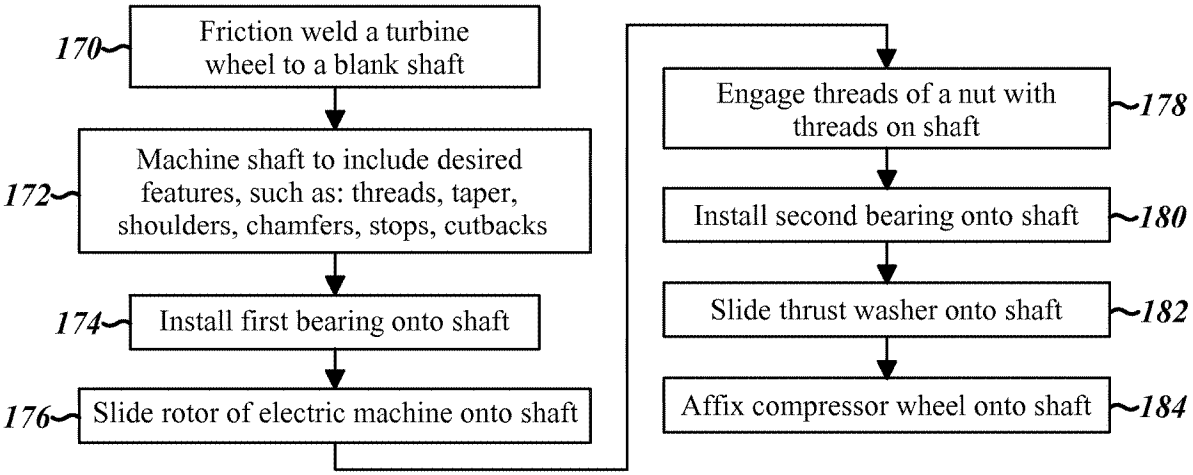
FIG. 7 is a flowchart of assembling an ECT.

In FIG. 7, a portion of the assembly of an ECT is shown. The turbine wheel is friction welded to a blank shaft in block 170. Any suitable assembly method can be alternatively used. In block 172, the shaft is machined to include the desired features, which could include one or more of: threads, tapers, shoulders, chamfers, stops, and cutbacks, as a non-limiting list. In block 174, the first bearing is installed by sliding it over the shaft. In block 176, the rotor is slid onto the shaft. This may be a press fit in which case the shaft is cooled, the rotor is heated, or both. In a different embodiment, the rotor and the shaft have threads and those threads are engaged to cause the rotor to be located on the shaft, possibly with a stop or shoulder for axial location. Or in yet another embodiment, splines on one of the shaft or rotor engage with grooves on the other element. Block 178 only refers to embodiments in which a nut is used to secure the rotor onto the shaft. Threads of the nut are engaged with the threads of the shaft in such embodiments. During the engagement, the rotor hits a stop or shoulder, in some embodiments, or engages with a taper as far as desired, in other embodiments. In block 180, the second bearing is slid onto the shaft. In block 182, the thrust washer is slid onto the shaft. The thrust washer has not been discussed previously, but is shown in FIG. 1. The compressor wheel is affixed to the shaft via any suitable technique in block 184.

Several alternatives have been described above for retaining the rotor onto the shaft including at least: tapers, a shoulder, splines, a nut, and a collar. Further, many examples of surfaces that may be roughened to prevent relative rotation of adjacent members. And, many types of electric motors may be used in place of the permanent magnet motor disclosed herein. Not every suitable combination has been illustrated in the drawings. The drawings are not intended to be limiting and additional combinations than those explicitly shown and described are within the scope of the disclosure.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

We claim:

1. An electronically-controlled turbomachine (ECT), comprising:

a shaft having a turbine end and a compressor end with a turbine wheel coupled onto the turbine end of the shaft, the shaft defining an exterior taper with a diameter of the exterior taper decreasing monotonically in a direction moving away from the turbine wheel;

a rotor mounted onto the shaft, the rotor including a rotor core with an end of the rotor core defining an interior taper having an interior diameter decreasing monotonically in the direction moving away from the turbine wheel, the interior taper of the rotor core engaging and mating with the exterior taper of the shaft;

a first bearing having a first internal diameter, the first bearing being mounted on the shaft between the turbine wheel and the rotor; and a second bearing having a second internal diameter, the second bearing being mounted on the shaft between the rotor and the compressor end of the shaft wherein the first diameter is greater than the second diameter.

2. The ECT of claim 1, wherein at least one of the interior and exterior tapers is roughened by one of: knurling, bead blasting, etching, sand blasting, laser vapor deposition, laser etching, and applying a coating.

3. An electronically-controlled turbomachine (ECT), comprising:

a shaft having a turbine end and a compressor end with a turbine wheel coupled onto the turbine end of the shaft;

a rotor mounted onto the shaft;

a first bearing having a first internal diameter, the first bearing being mounted on the shaft between the turbine wheel and the rotor; and a second bearing having a second internal diameter, the second bearing being mounted on the shaft between the rotor and the compressor end of the shaft wherein the first diameter is greater than the second diameter, wherein the shaft has one of a taper and a shoulder located proximate an end of the rotor proximate the turbine wheel; and the shaft has threads defined therein along a portion of the length of the shaft proximate an end of the rotor away from the turbine wheel, the ECT further comprising: a nut that engages with the threads and abuts the rotor on the end of the rotor away from the turbine wheel.

4. The ECT of claim 3, wherein the rotor is press fit onto the shaft between the first and second bearings at least for a portion of the rotor.

5. The ECT of claim 3, wherein the shaft has the shoulder located proximate the end of the rotor proximate the turbine wheel, and wherein the end of the rotor proximate the turbine wheel abuts the shoulder.

6. An electronically-controlled turbomachine (ECT), comprising:

a shaft having a turbine end and a compressor end with a turbine wheel coupled onto the turbine end of the shaft;

a rotor mounted onto the shaft;

a first bearing having a first internal diameter, the first bearing being mounted on the shaft between the turbine wheel and the rotor; and a second bearing having a second internal diameter, the second bearing being mounted on the shaft between the rotor and the compressor end of the shaft wherein the first diameter is greater than the second diameter, wherein the rotor is press fit onto the shaft at a first section of the rotor proximate the turbine end and at a second section of the rotor on an end of the rotor away from the turbine wheel; and the shaft is cutback between the first and second sections so that the inside of the rotor and the shaft do not contact each other in the area of the cutback.

7. The ECT of claim 6, wherein the first and second bearings are fully floating bearings and include an oil groove.

8. The ECT of claim 6, wherein the rotor has internal threads; the shaft has external threads; and the rotor is mounted on the shaft by engaging the threads of the rotor with the threads of the shaft.

9. The ECT of claim 6, wherein the rotor is press fit onto the shaft between the first and second bearings at least for a portion of the rotor.

10. An electronically-controlled turbomachine (ECT), comprising:

a shaft having a turbine end and a compressor end with a turbine wheel coupled onto the turbine end of the shaft;

a rotor mounted onto the shaft;

a first bearing having a first internal diameter, the first bearing being mounted on the shaft between the turbine wheel and the rotor; and a second bearing having a second internal diameter, the second bearing being mounted on the shaft between the rotor and the compressor end of the shaft wherein the first diameter is greater than the second diameter, wherein an end of the rotor has grooves defined therein; the shaft has splines defined therein; the splines mate with the grooves upon assembly of the rotor onto the shaft to thereby prevent relative radial motion of the rotor with respect to the shaft; and the shaft is threaded upon a portion of its length at a location near the compressor end of the shaft, the ECT further comprising: a nut that engages with the threads of the shaft and abuts the rotor near the compressor end of the shaft.

* * * * *